United States Patent [19]

Eneman

[11] 4,109,583

[45] Aug. 29, 1978

[54] PROJECTILE FUZE

[75] Inventor: Melvin Eneman, New York, N.Y.

[73] Assignee: The United States of America as represented by the Secretary of the Army, Washington, D.C.

[21] Appl. No.: 819,306

[22] Filed: Jul. 27, 1977

Related U.S. Application Data

[63] Continuation-in-part of Ser. No. 675,429, Apr. 9, 1976, abandoned.

[51] Int. Cl.[2] ..... F42C 15/22

[52] U.S. Cl. ..... 102/244; 102/273

[58] Field of Search ..... 102/79, 80, 73 A, 74, 102/70 R, 73 R

[56] References Cited

U.S. PATENT DOCUMENTS

| | | | |
|---|---|---|---|
| 2,167,197 | 7/1939 | Brandt | 102/79 |
| 2,856,855 | 10/1958 | Horowitz | 102/80 X |
| 3,033,115 | 5/1962 | Guene | 102/79 X |
| 3,118,379 | 1/1964 | Jasse | 102/79 |
| 3,353,489 | 11/1967 | Berger | 102/79 |
| 3,616,757 | 11/1971 | Berger | 102/79 |
| 3,882,782 | 5/1975 | Simmen | 102/79 |
| 3,913,486 | 10/1975 | Kosonocky et al. | 102/79 X |
| 4,004,521 | 1/1977 | Andrejkovics | 102/80 |

*Primary Examiner*—David H. Brown

*Attorney, Agent, or Firm*—Nathan Edelberg; Harold H. Card, Jr.; A. Victor Erkkila

[57] ABSTRACT

A low cost graze sensor fuze arrangement for a point detonating spin stabilized projectile in which firing pin actuation for detonation purposes is accomplished where the projectile may only graze the target and a graze sensor element will cam a firing pin assembly rearwardly toward a rotor armed detonator.

4 Claims, 2 Drawing Figures

PROJECTILE FUZE

The invention described herein may be manufactured, used and licensed by or for the Government for governmental purposes without the payment to me of any royalty thereon.

This is a continuation-in-part of pending prior application Ser. No. 675,429 filed on Apr. 9,1976, now abandoned.

This invention relates to projectile fuzes and to fuze arrangements for a point detonating spin stabilized projectile. More particularly, the invention relates to a novel arrangement of parts in a projectile fuze for moving a firing pin forward during the flight of the projectile, and for moving the firing pin rearwardly upon hitting or grazing a target. The present invention is particularly, though not exclusively, useful in fuzes of the type wherein the forward movement of a firing pin cause an explosive, such as a prime charge or detonator, for example, to move into a position for detonation upon the subsequent rearward motion of the firing pin, as for example, in U.S. Pats. No. 3,118,379, 3,616,757, and 3,882,782; and these patents are incorporated herein by reference.

It is an object of the invention to provide a graze sensor fuze arrangement for a point detonating spin stabilized projectile.

Another object of the invention is to provide such an arrangement having a minimum of cost.

A further object of the invention is to provide such an arrangement having a minimum of parts and a minimum of critical tolerance requirements.

Figure 2:
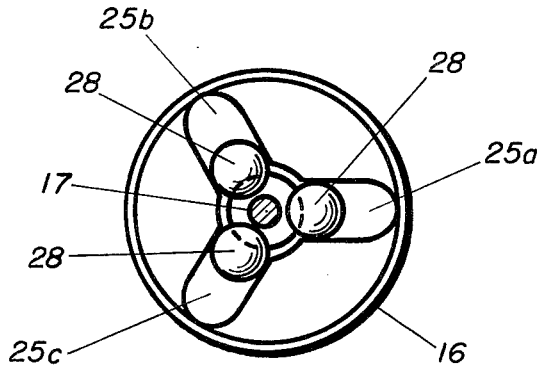
Figure 1:
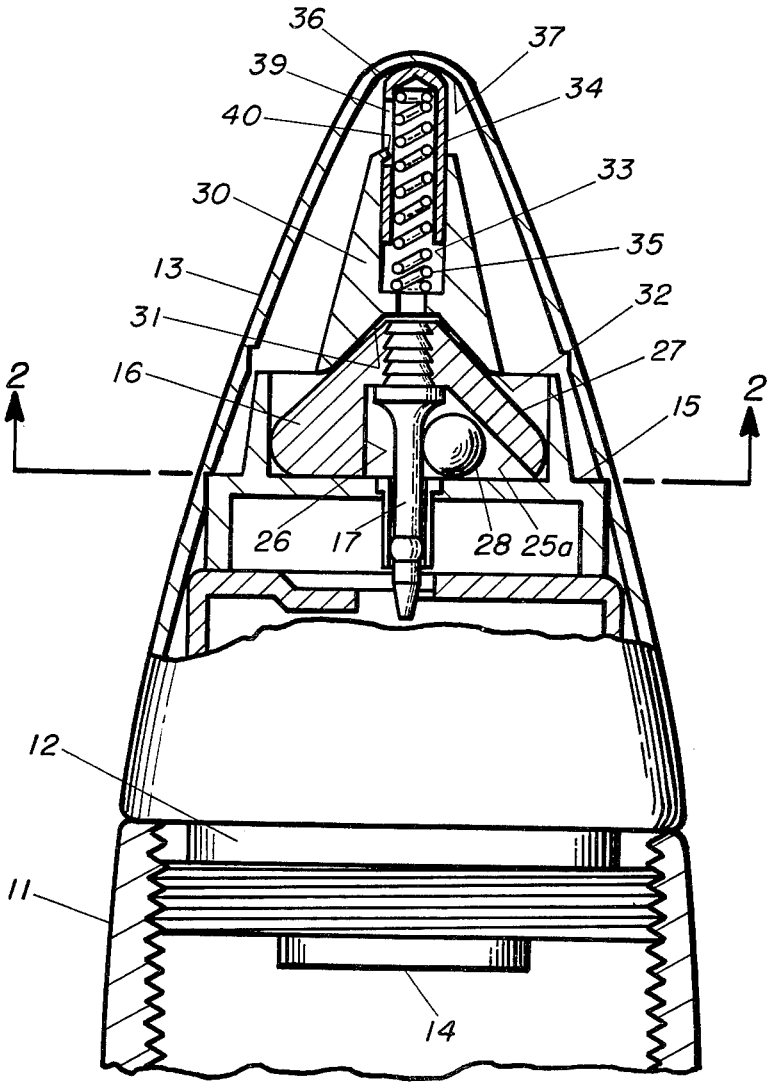

These and other objects, features and advantages will become more apparent from the following description and accompanying drawing, in which:

FIG. 1 is a partial sectional view of a preferred unarmed projectile fuze arrangement embodying the principles of the inventin, and FIG. 2 is a cross-section view of an annular firing pin assembly of the fuze, taken along the line 2—2 in FIG. 1, and viewed in the direction of the arrows.

A point detonating spin stabilized projectile 11 has an internally threaded forward opening in which is secured an externally threaded portion of fuze housing or body 12 of the novel projectile fuze that securely carries a forward nose member 13 and a centrally located explosive assembly 14. The explosive assembly 14 may be any explosive assembly of the type that cause the projectile 11 to go from a safe condition to an activated condition so that the explosive assembly may be detonated when the projectile 11 hits or grazes a target. The explosive assemblies of the aforementioned patents, incorporated herein by reference, are suitable for use in the novel projectile fuze. The internal surface of the substantially conically tapered nose member 13 is suitably recessed to facilitate a secure mounting of fuze forward housing 15 therewithin. Fuze forward housing 15 has *s* forwardly opening recess in which an annular firing pin assembly element 16 is slidably mounted. The fuze forward housing 15 has a central longitudinal passage accommodating a longitudinally movable firing pin 17 that is secured to, and protrudes rearwardly from element 16.

Firing pin assembly element 16 has a plurality (prefereably 3) of equally spaced triangular shaped slots 25*a*, 25*b*, and 25*c*, as shown in FIG. 2, formed or provided in its rearmost surface and which intersect or communicate with the commonly adjacent rearwardly opening cylindrical recess 26 that houses the flared enlargement of firing pin 17. Each of the slots 25*a*, 25*b*, and 25*c* preferably has a portion that is substantially parallel to corresponding portions of the conically tapered forward external surface portion 27 of the annular element 16. Corresponding camming balls 28, one positioned in each of the triangular slots, in response to a projectile spin developed centrifugal force cooperatively cam the firing pin assembly 16 forward to arm the firing pin 17 and a graze sensor arrangement hereinafter described.

A substantially frustro-conical graze sensor element 30 has a tapered rearwardly opening annular recess 31 overlying a substantial forward portion of conical surface 27, the rearmost portion of recess 31 terminating in a flared annular surfce 32 to cooperatively define a camming surface in at least partial contact with conical surfce 27 and having a multitude of potential camming portions. Graze sensor 30 has a forwardly opening cylindrical recess 33 in which is slidably mounted a rearwardly opening tubular sleeve 34 that contains an appropriate compression spring 35. The closed forward end 36 of sleeve 34 has a substantially hemispherical external surface of substantially smaller radial dimensions than the interior rounded tip surface portion 37 of nose member 13 to permit lateral tipping, rocking or rolling motion of elements 34 and 30 relative to nose surface 37. Spring 35, being seated against both the sleeve closed end 36 and the base of graze sensor recess 33, will bias and maintain sleeve contact with nose surface 37 except for a temporary period during set back as a result of projectile launch. Preferably, the sleeve sidewall has an elongated longitudinally extending slot 39 in which is slidably mounted an inwardly directed protuberance 40 of graze sensor element 30 as formed upon assembly.

Upon projectile launch, set back forces will cause sleeve 34 to further compress spring 35 and bottom or seat against the base of graze sensor recess 33. In response to centrifugal force of the spinning launched projectile, outward movement of cam balls 28 against the inclined surfaces of the slots 25*a*, 25*b*, and 25*c* will forwardly move elements 16, 30 and 34 to arm the firing pin 17 and graze sensor 30. Also, during the flight of the spinning launched projectile 11, the explosive assembly 14 is activated, as, for example, in the aforementioned patents incorporated by reference herein; and an explosive material, such as a primer or detonator charge, is positioned to be fired by the rearward motion of the firing pin 17.

Should the nose tip make a direct target impact, elements 34, 30 and 16 will be thrust rearwardly and the firing pin 17 will fire the explosive assembly 14. However, should the projectile 11 only graze impact the target, the resulting lateral force component will tip, rock, or roll elements 34 and 30 within the nose tip and cam element 16 rearwardly to thrust the firing pin 17 into the explosive assembly 14, thereby exploding the projectile 11.

Various modifications, changes or alterations may be resorted to without departing from the scope of the invention as set forth in the claims.

I claim:

1. In a point detonating spin stabilized projectile having a tapered forward nose member and a fuze forward housing secured in said nose member, said fuze forward housing having a central longitudinal passage accommodating a longitudinally movable firing pin, said fuze forward housing having a forwardly opening recess containing a firing pin assembly, said firing pin assembly including said firing pin and an element having a plurality of slotted inclined walls a camming ball adjacent each of said slotted inclined walls, each of said balls being responsive centrifugal force for forwardly camming said firing pin assembly to arm said firing pin, said firing pin assembly having a conically tapered forward external surface portion, a graze sensor having a tapered rearwardly opening recess defining a camming surface in at least partial contact with said conical surface portion, said graze sensor having a forwardly opening cylindrical recess, a rearwardly opening tubular sleeve slidably mounted in said cylindrical recess, and a compression spring in said sleeve for forwardly biasing said sleeve against said nose member.

2. The structure in accordance with claim 1 wherein said sleeve has an elongated slot in its sidewall, and said graze sensor has an inwardly directed protuberance positioned in said slot.

3. The structrue according to claim 1 wherein said inclined walls have portions that are substantially parallel to corresponding portions of said conical surface portion.

4. The structure of claim 1 wherein the rearmost portion of said graze sensor tapered recess is defined by a substantially flared annular surface.

* * * * *